US007432643B2

(12) United States Patent
Haba et al.

(10) Patent No.: US 7,432,643 B2
(45) Date of Patent: Oct. 7, 2008

(54) LIGHTING DEVICE

(75) Inventors: Masanori Haba, Tokyo (JP); Hirokazu Fujii, Hyogo (JP)

(73) Assignee: Dialight Japan Co., Ltd., Osaka (JP)

( * ) Notice: Subject to any disclaimer, the term of this patent is extended or adjusted under 35 U.S.C. 154(b) by 621 days.

(21) Appl. No.: 11/058,362

(22) Filed: Feb. 16, 2005

(65) Prior Publication Data

US 2005/0212402 A1 Sep. 29, 2005

(30) Foreign Application Priority Data

Mar. 25, 2004 (JP) ..... P2004-089051
Aug. 30, 2004 (JP) ..... P2004-249718
Aug. 30, 2004 (JP) ..... P2004-249719

(51) Int. Cl.
*H01J 1/62* (2006.01)

(52) U.S. Cl. ..... 313/495

(58) Field of Classification Search ..... 313/495, 313/309, 310, 336, 351
See application file for complete search history.

(56) References Cited

U.S. PATENT DOCUMENTS 5,600,200 A * 2/1997 Kumar et al. ..... 313/346 R
6,020,677 A * 2/2000 Blanchet-Fincher et al. 313/336

FOREIGN PATENT DOCUMENTS

| | | | |
|---|---|---|---|
| JP | 10-265699 | A | 9/1998 |
| WO | WO 97/07531 | | 2/1997 |
| WO | WO 01/09914 | A1 | 2/2001 |
| WO | WO 03/088308 | A1 | 10/2003 |

OTHER PUBLICATIONS

European Search Report, issued in corresponding European Patent Application No. 05006039.1-2208, dated on Dec. 6, 2007.

* cited by examiner

*Primary Examiner*—Vip Patel
(74) *Attorney, Agent, or Firm*—McDermott Will & Emery LLP

(57) ABSTRACT

A lighting device of the present invention has a wire-shaped cathode provided along an axial direction, a phosphor-coated anode that opposes to the wire-shaped cathode in the axial direction and a vacuum sealing tube that vacuum-seals these cathode and anode, wherein the wire-shaped cathode has a wire and a carbon film provided on the entire circumference of this wire, and the phosphor-coated anode has an anode section and a phosphor section provided on this anode section.

12 Claims, 8 Drawing Sheets

LIGHTING DEVICE

BACKGROUND OF THE INVENTION

1. Field of the Invention

The present invention relates to a lighting device using a field-emission type electron emitter.

2. Description of the Prior Arts

There has conventionally been proposed a lighting device, for example, disclosed in Japanese Unexamined Patent Application No. HEI10-255699 as a lighting device using a field-emission type electron emitter. This lighting device has a pair of flat glass substrates in a vacuum sealing tube, wherein an electron emitter (cathode section) is provided at one of the flat glass substrates and a phosphor-coated transparent electrode film (anode section) is provided at the other flat glass substrate. It is configured such that electrons emitted from the cathode section collide with the plane phosphor to excite the phosphor, thereby emitting visible light in one direction in a plane manner. This lighting device is utilized for a flat display or the like. It has been considered that the lighting device described above is utilized as a so-called backlight device that illuminates a liquid crystal panel from its backside. However, a demand for reducing a size or reducing power consumption has been more and more increased recently in an electronic device into which a liquid crystal display panel is incorporated, such as a liquid crystal television set. Therefore, the above-mentioned lighting device using the electron emitter is required not only to be capable of emitting light in all directions, not in a plane direction, but also to be capable of coping with a thin size that can be incorporated in the narrow backside of the electronic device and emitting light with high intensity even with reduced power consumption, when it is incorporated into the electronic device as the backlight device.

SUMMARY OF THE INVENTION

A lighting device according to the present invention has a wire-shaped cathode provided along an axial direction, a phosphor-coated anode that opposes to the wire-shaped cathode in the axial direction and a vacuum sealing tube that vacuum-seals these cathode and anode, wherein the wire-shaped cathode has a wire and a carbon film provided on the circumference of this wire as an electron emitter, and the phosphor-coated anode has an anode section and a phosphor section provided on this anode section.

Preferably, the wire-shaped cathode has a concave/convex formed on its surface, and the carbon film is formed on the surface of the concave/convex with a sharp or relatively sharp shape.

The above-mentioned "linear" is not limited to a straight line shape, but includes a curved line such as a spiral shape or wave-like shape and a shape wherein a curved line and straight line are mixed. Further, it does not matter whether it has a solid-core or is hollow. Further, its sectional shape is not particularly limited. Specifically, its sectional shape is not limited to a circle, but may be an ellipse, rectangle or other shape. The above-mentioned "concave/convex" includes from a concave/convex having a visible size made of projections or grooves to a concave/convex having a microscopic size formed by surface roughness or the like. Its size does not matter. The carbon material includes a microscopic sharp section, for example tube-type and wall-type carbon material. The sharpness of the above-mentioned "relatively sharp" is determined according to the field electron emission property, and the shape having somewhat roundness can be included in the sharp shape.

In the lighting device of the present invention, the vacuum sealing tube is made thin, whereby it can meet the demand for reducing a size of the backlight device incorporated in the backside of the liquid crystal panel with a reduced size of the electronic device such as a liquid crystal television set.

Further, the concave/convex is formed on the surface of the wire-shaped cathode provided in the vacuum sealing tube and the carbon film is formed on the concave/convex surface as the electron emitter, whereby the field concentration is easy to occur at the field electron emitter. Therefore, the lighting device of the present invention can emit light with high luminous brightness sufficient for the liquid crystal backlight by applying extremely low power. Specifically, the present invention can simultaneously establish, as the backlight for the liquid crystal panel, both the technical demand for decreasing the diameter of the tube and the technical demand for giving sufficient luminous brightness to the liquid crystal panel.

Moreover, the wire-shaped cathode and the phosphor-coated anode are arranged so as to oppose to each other along the longitudinal direction of the vacuum sealing tube in the present invention, so that visible light can be emitted from the entire circumference of the vacuum sealing tube. Accordingly, the present invention can provide a lighting device that is made thin in order to be incorporated in the backside space of the electronic device as a backlight device and that can emit light with high intensity even with reduced power consumption.

Further, the present invention makes it possible to emit visible light from all directions of the vacuum sealing tube, thereby being applied to a flat display.

DETAILED DESCRIPTION OF PREFERRED EMBODIMENTS OF THE INVENTION

A lighting device according to an embodiment of the present invention is explained hereinafter with reference to the drawings.

Figure 1:
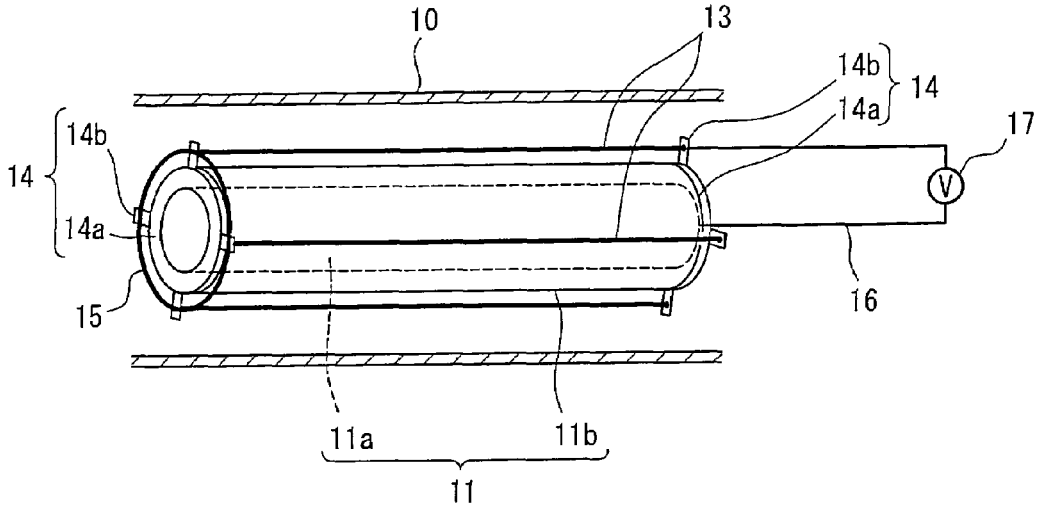
FIG. 1 is a partially cutaway perspective view of a lighting device according to an embodiment of the present invention.
Figure 2:
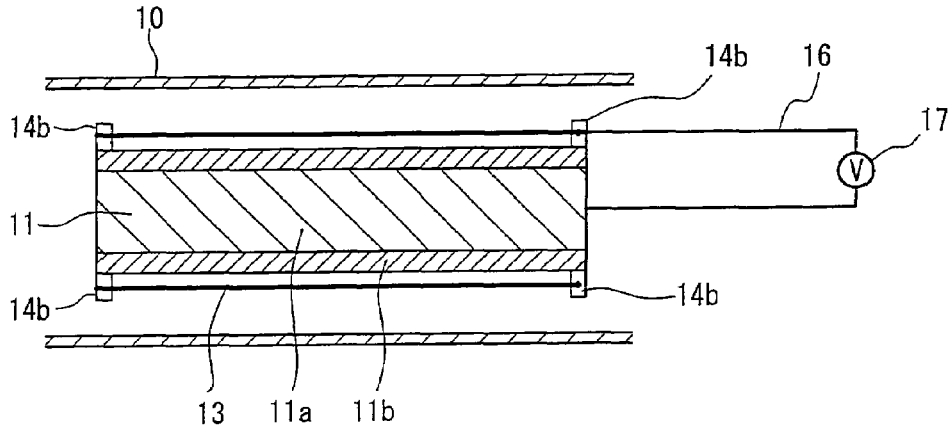
FIG. 2 is a sectional view of the lighting device according to the embodiment of the present invention.
Figure 3:
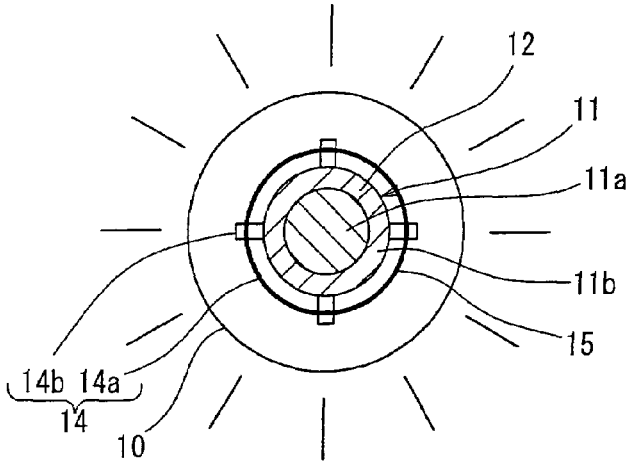
FIG. 3 is a front view of the lighting device according to the embodiment of the present invention.

FIG. 1 is a partially cutaway perspective view of the lighting device, FIG. 2 is a sectional view of the lighting device and FIG. 3 is a front view of the lighting device. The lighting device vacuum-seals a phosphor-coated anode 11 and a wire-shaped cathode 13 in a vacuum sealing tube 10. Both ends of the vacuum sealing tube 10 are closed to vacuumize its inside, but both ends are not shown in the drawing for better understanding. The phosphor-coated anode 11 is composed of an anode section 11*a* and a phosphor section 11*b*. The vacuum sealing tube 10 is made of a cylindrical glass tube, wherein its inside is made vacuum or generally vacuum. The anode section 11*a* is made of a metal such as aluminum, copper, Ni or SUS. The anode section 11*a* may be a solid-core structure or hollow. It has on its surface a face suitable for the adhesivity of the phosphor section 11*b* and the reflectivity of emitted light from the phosphor section 11*b*. The phosphor section 11*b* is formed on the whole outer circumference of the anode section 11*a*. The wire-shaped cathode 13 is formed by a slender metal wire made of Ni, stainless, Fe or the like. Microscopic carbon-based linear materials such as carbon nano-tube and carbon nano-wall not shown are film-formed on the entire circumference of the wire-shaped cathode 13. Plural wire-shaped cathodes 13 are extended in the axial direction, and provided in the circumferential direction of the phosphor section 11*b* with a same space.

The configuration is preferable such that the space between the wire-shaped cathodes 13 and the phosphor section 11*b* is increased to apply high potential or the number of the wire-shaped cathodes 13 is increased to narrow the space between them in order to emit electrons on all faces of the phosphor section 11*b*. A spacer 14 is used for setting the separation space between the phosphor section 11*b* and the wire-shaped cathodes 13 to a predetermined distance. The spacer 14 is composed of a ring member 14*a* fitted to the outside of the phosphor section 11*b* and plural projecting members 14*b* around the circumference of the ring member 14*a*. The wire-shaped cathodes 13 are bridged between the opposing projecting members 14*b* of each spacer 14 provided on the outer circumference at both ends of the phosphor section 11*b* and arranged to have a predetermined space with respect to the surface of the phosphor. The ring member 14*a* may be adhered to the phosphor section 11*b*. The wire-shaped cathodes 13 are electrically connected to each other via a conductor 15.

A pulse power source 17 is connected between the phosphor-coated anode 11 and the wire-shaped cathode 13 via an electric wire 16 for applying voltage between the phosphor-coated anode 11 and the wire-shaped cathode 13. The wire-shaped cathode 13 emits electrons by the application of voltage. The emitted electrons collide with the phosphor section 11*b* of the phosphor-coated anode 11 to emit light. The brightness of this light-emission becomes 200,000 Cd when the pulse voltage is increased until a current of 1 mA/cm$^2$ flows. The condition in this case is as follows. The wire-shaped cathodes 13 each having a diameter of 1 mm and a length of 10 cm were arranged with a distance of 3 mm around the phosphor-coated anode 11 having a diameter of 2 mm and a length of 10 cm. The pulse voltage of 6 kV (1 KHz) was applied under the vacuum of $10^{-6}$ Torr, resulting in that current of 1 mA/cm$^2$ flew.

According to the lighting device described above, light is emitted from all faces of the vacuum sealing tube 10. Further, the spacer 14 is used to arrange the wire-shaped cathodes 13 around the outer periphery of the phosphor section 11*b*, so that the space between the wire-shaped cathodes 13 and the phosphor section 11*b* is easily set to a predetermined distance. Therefore, the space between the wire-shaped cathodes 13 and the phosphor-coated anode 11 can precisely be controlled. Specifically, the configuration wherein the space between the wire-shaped cathodes 13 and the phosphor-coated anode 11 was 0.5 mm could provide high efficiency of 300 lm/W with a voltage of 800 V.

Another Embodiment

Figure 4:
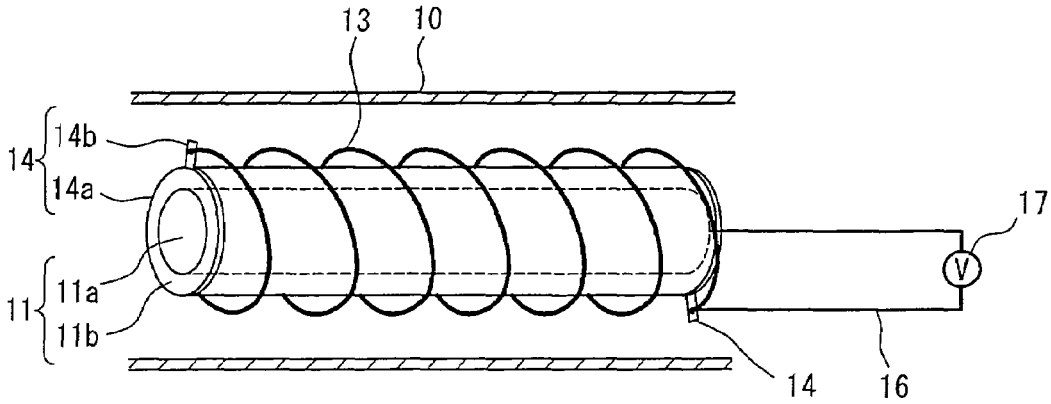
FIG. 4 is a partially cutaway perspective view of a lighting device according to another embodiment of the present invention.
Figure 5:
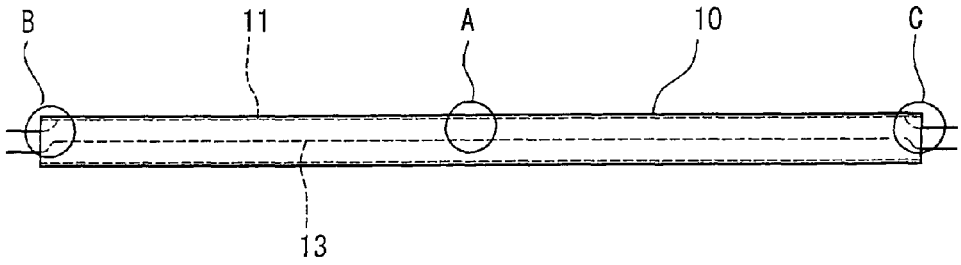
FIG. 5 is a sectional view of a field electron emission type fluorescent tube for a backlight according to still another embodiment of the present invention.
Figure 6:
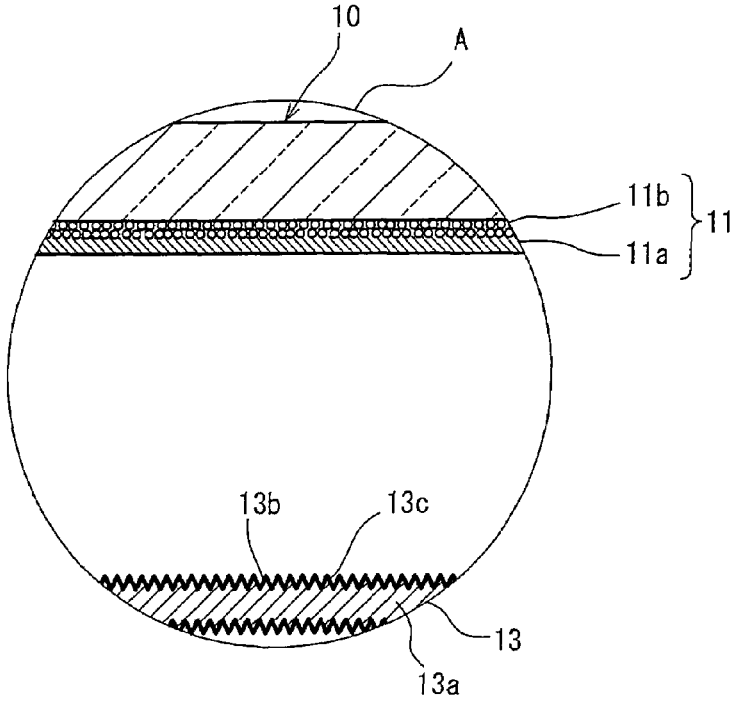
FIG. 6 is an enlarged view of a section encircled by a circle A in FIG. 5.
Figure 7:
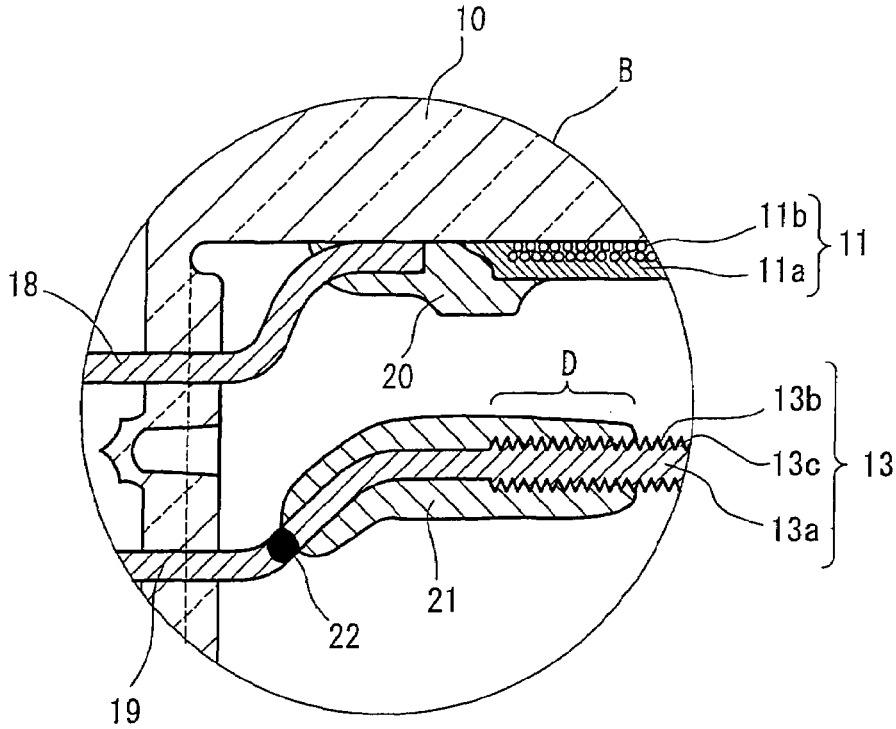
FIG. 7 is an enlarged view of a section encircled by a circle B in FIG. 5.
Figure 8:
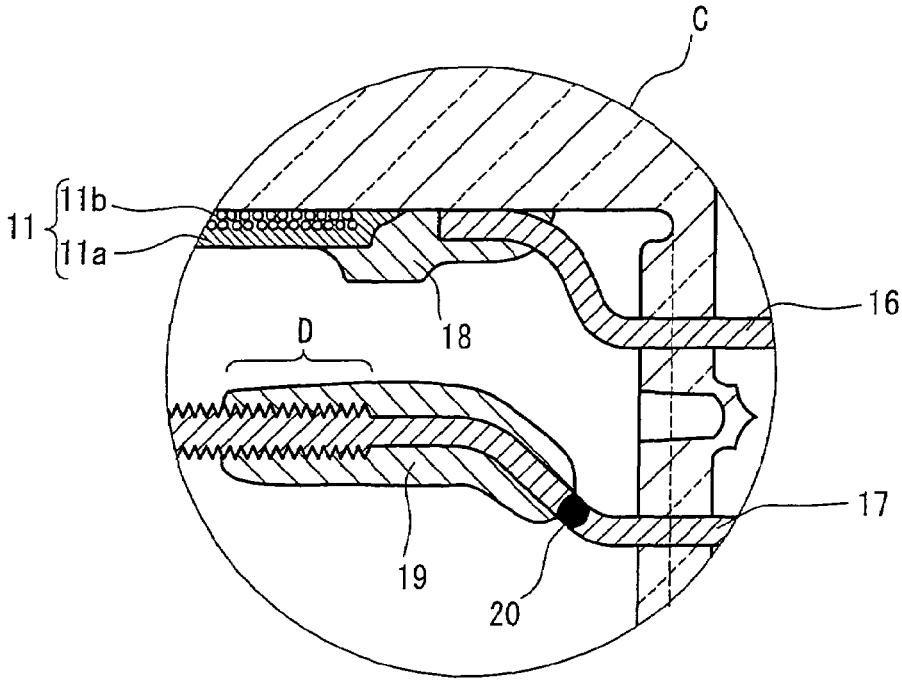
FIG. 8 is an enlarged view of a section encircled by a circle C in FIG. 5.

In a lighting device shown in FIG. 4, the wire-shaped cathode 13 is formed into a spiral shape and wound around the surface of the phosphor with a predetermined space. The spacer 14 is formed such that one projecting member 14*b* is provided at the ring member 14*a* so as to bend in the outward direction. The spacer 14 is fitted to the outside of both ends of the phosphor-coated anode 11. The wire-shaped cathode 13 has a carbon film such as carbon nano-wall formed on the entire circumference and is spirally wound around the phosphor-coated anode 11. Both ends of the wire-shaped cathode 13 are fixed to the projecting member 14*b* of the spacer 14. This allows the wire-shaped cathode 13 to be arranged to have a predetermined space between the surface of the phosphor and the wire-shaped cathode 13. When voltage is applied between the wire-shaped cathode 13 and the phosphor-coated anode 11, electrons are emitted from the wire-shaped cathode 13. The emitted electrons collide with the phosphor section 11*b* and emit light. The lighting device described above can also emit light from all faces and the space between the linear material and the phosphor can easily be set to a predetermined distance. Further, the wire-shaped cathode 13 is spirally formed and arranged around the phosphor-coated anode 11, whereby the lighting device described above is suitable to easily emit light from 360-degree circumference of the phosphor section 11*b*.

Still Another Embodiment

A lighting device according to still another embodiment of the present invention will be explained with reference to FIGS. 5 to 8. The vacuum sealing tube 10 has a long size of, for example, 250 mm in tube length and has a thin-tube structure with, for example, an outer diameter of 15 mm and inner diameter of 10 mm. The vacuum sealing tube 10 may be a straight tube or U-shaped tube.

The phosphor-coated anode 11 has a thickness of, for example, 1 μm, and is provided so as to be in close contact with the inner surface of the vacuum sealing tube 10 from its beginning end on the right side in the figure to its terminal end on the left side in the figure. Further, the phosphor-coated anode 11 is composed of a laminated phosphor section 11*b* made of phosphor powders that emit white light by an electron beam excitation and a laminated anode section 11*a* formed by depositing a metal excellent in conductivity, preferably aluminum.

The method for forming the phosphor-coated anode 11 is as follows. A binder such as PVA (polyvinyl alcohol) that volatilizes by burning at 450 degrees and aqueous liquid for adjusting viscosity are added to the phosphor powders that emit white light due to the electron beam excitation under air or under reduced pressure atmosphere of nonoxidizing gas such as nitrogen or the like to thereby prepare a slurry. This slurry is applied on the inner surface of the vacuum sealing tube 10 and dried to form the phosphor section 11*b*. Subsequently, an organic slurry is applied to make the surface of the phosphor section 11*b* flat, and then, sufficiently dried. Thereafter, aluminum is deposited so as to have a thickness of about 0.1 to 0.3 μm by using an aluminum deposition device. With this deposition state, it is put into an electric furnace to remove the binder at 450 degrees and to bring the phosphor powders in close contact with the inner surface of the vacuum sealing tube 10, thereby forming the anode section 11*a*. As described above, the phosphor-coated anode 11 having a two-layered structure of the phosphor section 11*b* and the anode section 11*a* is formed at the inner surface of the vacuum sealing tube 10.

The wire-shaped cathode 13 is provided on the side of the inner diameter of the phosphor-coated anode 11. The wire-shaped cathode 13 has a linear wire 13*a* having, for example, an outer diameter of 1 mm, although the outer diameter is not particularly limited. The surface of the wire 13*a* is formed to have a concave/convex 13*b*. The concave/convex 13*b* has a visible size and is uniformly formed generally all over the wire-shaped cathode 13 except for its beginning end and terminal end. The concave/convex 13*b* is formed by performing a screw cutting on the surface of the wire-shaped cathode 13 or by stretching the surface of the wire-shaped cathode 13. The concave/convex 13*b* is formed generally all over the wire-shaped cathode 13 and has a uniform or generally uniform height and sharpness with each other. This makes it possible to uniformly emit light with high intensity generally all over the wire-shaped cathode 13. The material of the wire 13*a* is not particularly limited. Examples of the material for the wire 13*a* preferably include stainless, graphite, Ni, Fe, Co or the like.

A carbon film 13*c* is formed on the concave/convex 13*b* on the surface of the wire-shaped cathode 13 as a field electron emitter. The carbon film 13*c* is made of a carbon material having a great number of microscopic sections that are microscopically sharp, preferably carbon nano-tube or carbon nano-wall. The microscopic shape of the carbon film 13*c* is not particularly shown in the figure.

The method for forming the carbon film 13*c* on the concave/convex 13*b* on the surface of the wire-shaped cathode 13 is not particularly limited. It can be formed by a well-known simple technique with low cost, such as, for example, screen printing, coating or CVD (chemical vapor deposition). The carbon nano-tube has, for example, a tube shape with an outer diameter of 1 to several 10 nm and a length of 1 to several μm. An electric field is easy to be concentrated on its leading end due to this tube shape, so that it has a characteristic of easily emitting electrons. It should be noted that the carbon nano-tube or carbon nano-wall is preferably formed directly on the wire 13*a* from the viewpoint of electrical connection. Further, the carbon nano-wall is preferably formed directly on the surface of the concave/convex 13*b* of the wire 13*a* by a plasma CVD method. This is because the carbon nano-wall does not require a catalyst that is required for the carbon nano-tube.

In the combination of the concave/convex 13*b* and the carbon film 13*c*, the concave/convex 13*b* has a visible size and the carbon film 13*c* has a microscopic size. When the surface of the wire 13*a* is flat, the electron emission property is deteriorated only with the carbon film 13*c*. The concave/convex 13*b* is formed on the surface of the wire 13*a*, so that the carbon film 13*c*, for example, the carbon nano-wall or carbon nano-tube is likely to be concentrated on the projecting sections on the concave/convex 13*b* in particular. According to the experiment by the inventors, it was confirmed that the electron emission property was remarkably enhanced with a synergism of the shape of the projecting sections and the sharp leading end.

When voltage is applied between the wire-shaped cathode 13 and the phosphor-coated anode 11, an electric field is concentrated on the carbon film 13*c*, for example, on the sharp sections of the carbon nano-tube, whereby electrons penetrate through energy barrier due to a quantum tunnel effect to thereby be emitted into vacuum. The emitted electrons are attracted by the phosphor-coated anode 11 to collide with the same, by which the phosphor section 11*b* is excited to emit light.

The wire-shaped cathode 13 has a linear shape and is arranged so as to oppose to the phosphor-coated anode 11 in the vacuum sealing tube 10 from its beginning end to the terminal end with approximately equal distance. Therefore, it can emit light with uniform and high brightness by the application of reduced power consumption, thereby being extremely excellent for a backlight device.

A leader 18 is made of Kovar or the like for drawing the phosphor-coated anode 11 to the outside of the vacuum sealing tube 10. A leader 19 is made of Kovar or the like for drawing the wire-shaped cathode 13 to the outside of the vacuum sealing tube 10. A carbon paste 20 bonds the anode section 11*a* of the phosphor-coated anode 11 and the leader 18, while a carbon paste 21 bonds the wire-shaped cathode 13 and the leader 19. An area D at the terminal end of the wire-shaped cathode 13 is covered with the carbon paste 21, so that the electric field concentration is prevented at the terminal end. The thermal expansion coefficient of each of the leaders 18 and 19 are agreed with that of the vacuum sealing tube 10, with the result that the leaders 18 and 19 are hardly affected by a change in temperature. Numeral 22 denotes a welding section.

A test described below was carried out to the backlight fluorescent tube provided with the above-mentioned construction.

Firstly, DC pulse voltage of 8 kV having a pulse width of 5 μs and frequency of 6 kHz was applied between the phosphor-coated anode 11 and the wire-shaped cathode 13 via the leaders 18 and 19 by using a high pulse power source 17. As a result, luminous brightness of 100,000 cd/m$^2$ was obtained.

Then, the pulse voltage was continuously applied for one week (24×7 hours=168 hours), and thereafter, the temperature of the outer wall of the vacuum sealing tube 10 was measured. As a result, the temperature was the same as the room temperature, which meant there was no temperature rise due to the emission of light, and consequently, there was no change in brightness. The result of this test shows that the backlight fluorescent tube according to the embodiment is greatly suitable for a backlight for lighting a liquid crystal display panel of a large-sized liquid crystal television set or the like from its backside with reduced power consumption and high intensity.

The backlight fluorescent tube provided with the above-mentioned construction can simultaneously establish, as the backlight for the liquid crystal panel, both the technical demand for decreasing the diameter of the tube and the technical demand for giving sufficient luminous brightness to the liquid crystal panel.

Still Another Embodiment

Figure 9A:
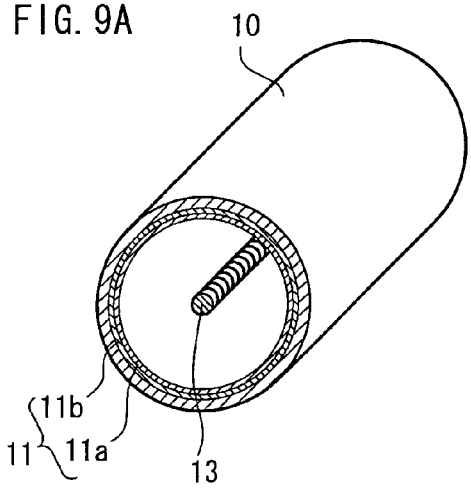
FIG. 9A is a perspective view showing a modified example of the thin tube and cathode section.
Figure 9D:
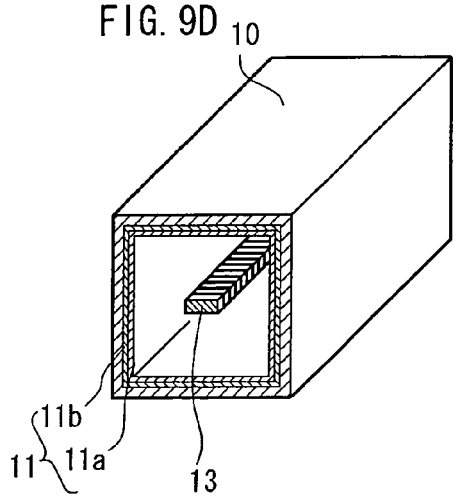
FIG. 9D is a perspective view showing still another modified example of the thin tube and cathode section.
Figure 9B:
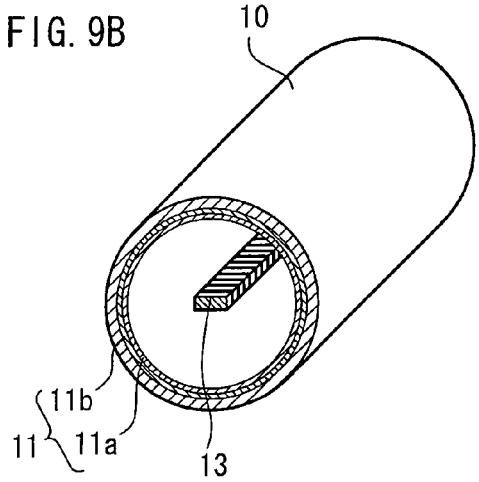
FIG. 9B is a perspective view showing another modified example of the thin tube and cathode section.
Figure 9E:
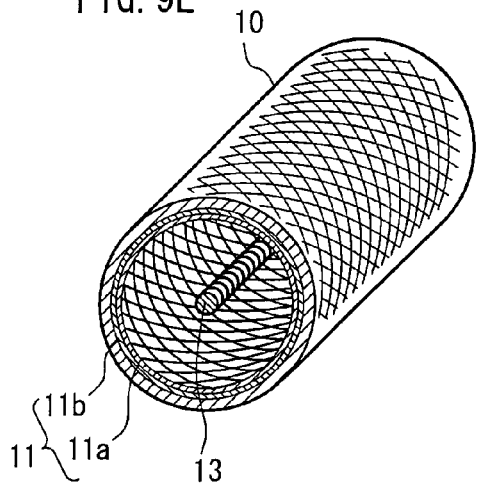
FIG. 9E is a perspective view showing a modified example of the anode section.
Figure 9C:
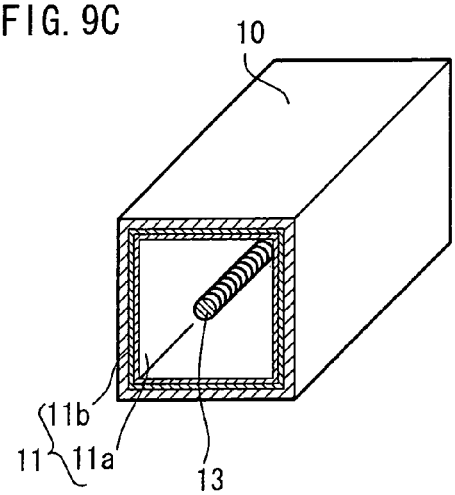
FIG. 9C is a perspective view showing still another modified example of the thin tube and cathode section.

FIG. 9A shows that the vacuum sealing tube 10 of the aforesaid embodiment is partially cut, FIG. 9B shows the rectangular sectional shape of the wire-shaped cathode 13 as compared to FIG. 9A and FIG. 9C shows the rectangular sectional shape of the vacuum sealing tube 10 and the circular sectional shape of the wire-shaped cathode 13. FIG. 9D shows the rectangular sectional shape of the vacuum sealing tube 10 and the rectangular sectional shape of the wire-shaped cathode 13. Each example of FIG. 9B and FIG. 9D has the same operational effect as the example of FIG. 9A. FIG. 9E shows a mesh-type phosphor-coated anode 11. Electrons can be emitted from the carbon film 13*c* even with the mesh-type phosphor-coated anode 11.

Still Another Embodiment

Figure 10:
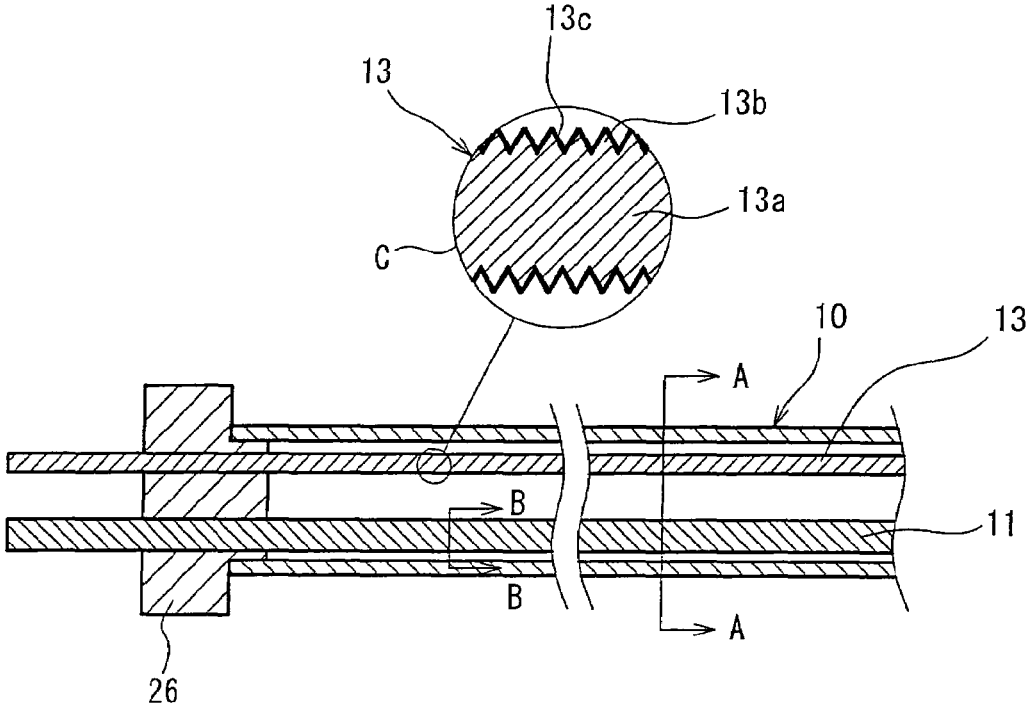
FIG. 10 is a sectional view of a field electron emission type fluorescent tube for a backlight according to still another embodiment of the present invention.
Figure 11:
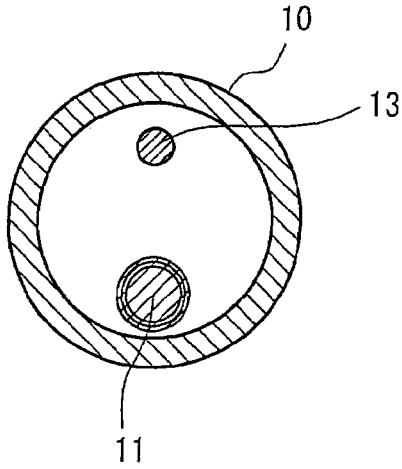
FIG. 11 is an enlarged view of a section taken along a line A-A in FIG. 10.
Figure 12:
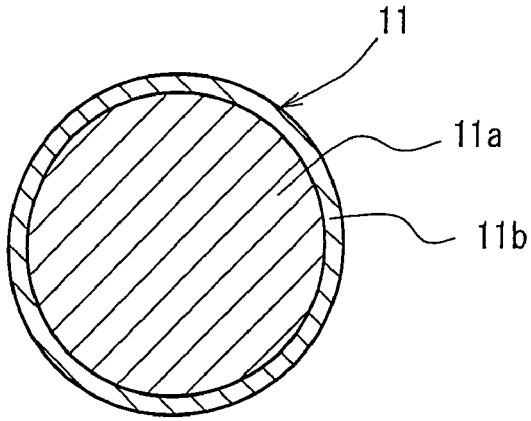
FIG. 12 is an enlarged view of a section taken along a line B-B in FIG. 10.

Referring to FIGS. 10 to 12, a linear-shaped phosphor-coated anode 11 is inserted into a thin tube 10, wherein one end thereof is supported by a glass stem 26 while the other end is supported by a quartz support not shown, whereby it is arranged parallel to the inner face of the vacuum sealing tube 10 in the vacuum sealing tube 10. The linear-shaped phosphor-coated anode 11 is composed of a core wire 11*a* made of nickel, Kovar or the like having a diameter of 0.5 mm and a phosphor film 11*b* formed on the outer face of the core wire 11*a*. The core wire 11*a* forms a light reflecting face with respect to the emission of light from the phosphor film 11*b*. The linear-shaped phosphor-coated anode 11 is formed such that a phosphor slurry is applied onto the outer surface of the core wire 11*a* with a spray method or dipping method, and dried. Thereafter, the resultant is burned at 450 degrees under air or under nitrogen airflow to thereby adhere the phosphor film 11*b* onto the outer surface of the core wire 11*a*. The phosphor material of the phosphor film 11*b* is not particularly limited so long as it emits light by the electron collision. The wire-shaped cathode 13 made of nickel having a diameter of 0.5 mm is inserted into the vacuum sealing tube 10 as separated from the linear-shaped phosphor-coated anode 11 by 2.0 mm. One end of the wire-shaped cathode 13 is supported by the Kovar glass stem 26 while the other end is supported by the quartz support not shown, whereby it is arranged parallel to the linear-shaped phosphor-coated anode in the vacuum sealing tube 10.

When a performance test was carried out to the backlight fluorescent tube provided with the aforesaid construction, luminous brightness of 30,000 cd/m$^2$ was obtained by the application of voltage of 5 kV.

Then, the voltage of 5 kV was continuously applied for one week (24×7 hours=168 hours), and thereafter, the temperature of the outer wall of the vacuum sealing tube 10 was measured. As a result, the temperature was the same as the room temperature, that meant there was no temperature rise due to the emission of light, and consequently, there was no change in brightness. As a result, it could be confirmed that the backlight fluorescent tube according to the embodiment was greatly suitable for a backlight for lighting a liquid crystal display panel from its backside with reduced power consumption, and entirely uniform and high intensity.

Still Another Embodiment

Figure 13:
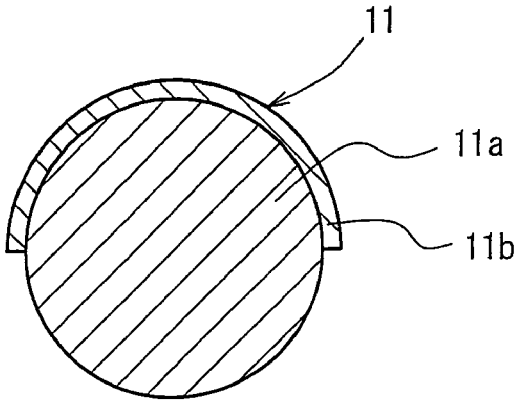
FIG. 13 is an enlarged sectional view of the modified example of the linear anode section at the line B-B in FIG. 10.

FIG. 13 shows another modified example in the section along the ling B-B in FIG. 10. As shown in FIG. 13, the phosphor film may be formed around generally semi-circumference of the outer surface of the core wire 11*a* in the linear-shaped phosphor-coated anode 11. Its forming method is as follows. A sealing agent is applied on generally semi-circumference of the core wire 11*a* so as not to apply the phosphor slurry on the entire circumference of the core wire 11*a*. With this state, the phosphor slurry is applied, thereby being capable of forming the phosphor film 11*c* on generally semi-circumference of the core wire 11*a*. In this case, the sealing agent can be volatilized or removed at approximately 300 degrees.

Applicable Example of the Embodiment

Figure 14A:
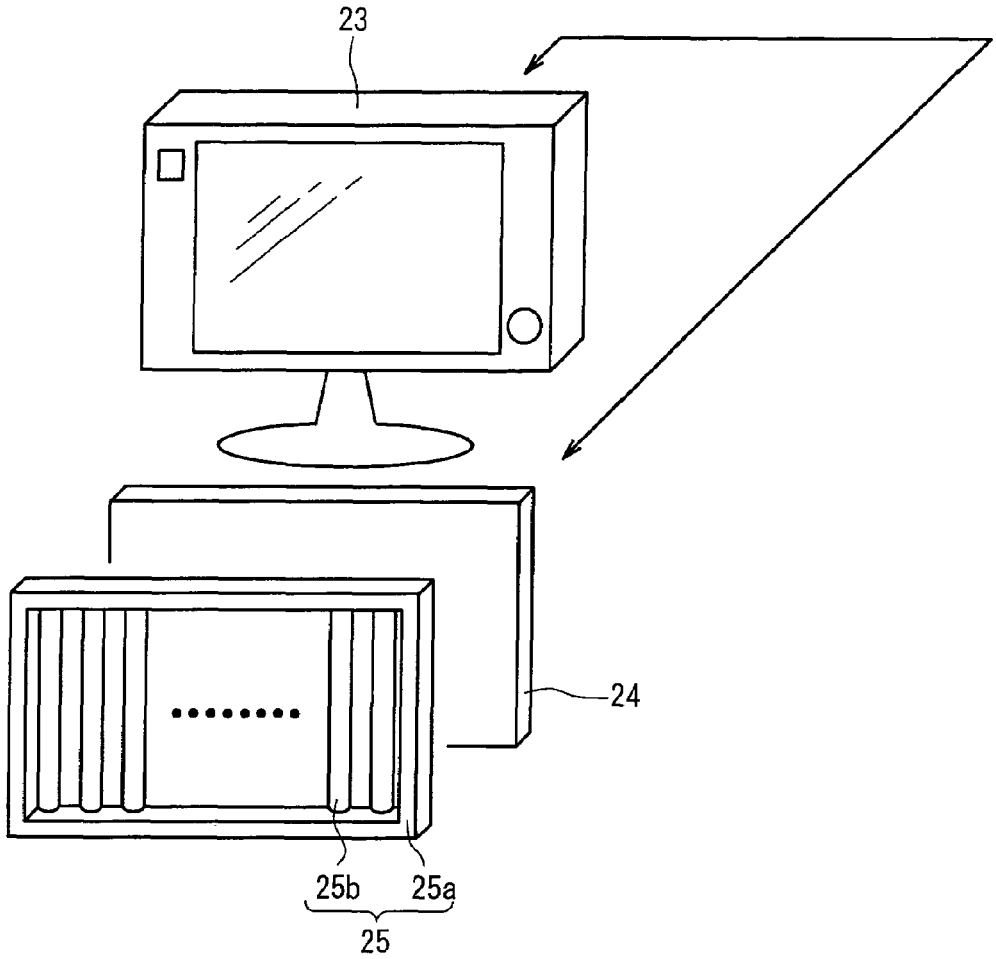
FIG. 14A is a perspective view showing a backlight device in which a field electron emission type fluorescent tube for a backlight according to the embodiment is incorporated and a liquid crystal television set provided with the backlight device.
Figure 14B:
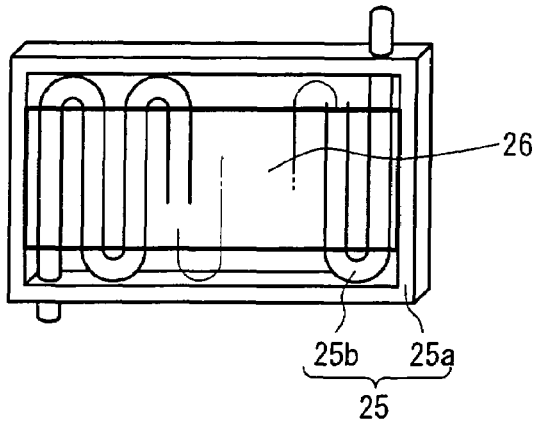
FIG. 14B is a view showing a modified example of the backlight using the field electron emission type fluorescent tube.

FIG. 14A shows a liquid crystal television set 23, a TFT liquid crystal display panel 24 incorporated in the liquid crystal television set 23 and a backlight device 25 that lights the backside of the TFT liquid crystal display panel 24. This backlight device 25 has a housing 25*a* for accommodating a backlight and a backlight 25*b* accommodated in the housing 25*a*. The backlight fluorescent tube of the embodiment is incorporated as the backlight 25*b*. The backlight 25*b* made of the backlight fluorescent tube may have a U-shape as shown in FIG. 14B. Numeral 26 denotes a light-emitting section.

What is claimed is:

1. A lighting device comprising:

a wire-shaped cathode provided along an axial direction;

a phosphor-coated anode that opposes to the wire-shaped cathode in the axial direction; and a vacuum sealing tube that vacuum-seals these cathode and anode, wherein the wire-shaped cathode has a wire and a carbon film provided on the outer circumference of this wire as an electron emitter, and the phosphor-coated anode has an anode section and a phosphor section provided on this anode section, and the wire-shaped cathode has a concave/convex formed on its surface, and the carbon film is formed on the surface of the concave/convex with a sharp or relatively sharp shape.

2. A lighting device of claim 1, wherein plural wire-shaped cathodes are equally spaced around the phosphor-coated anode.

3. A lighting device of claim 1, wherein the wire-shaped cathode is spirally formed.

4. A lighting device of claim 3, wherein the phosphor-coated anode has a linear shape and is arranged so as to oppose to the wire-shaped cathode in the vacuum sealing tube.

5. A lighting device of any one of claims 1, 2, and 3, wherein the material of the carbon film is carbon nano-tube or carbon nano-wall.

6. A lighting device comprising:

a wire-shaped cathode provided along an axial direction;

a phosphor-coated anode that opposes to the wire-shaped cathode in the axial direction; and a vacuum sealing tube that vacuum-seals these cathode and anode, wherein the wire-shaped cathode has a wire and a carbon film provided on the outer circumference of this wire as an electron emitter, and the phosphor-coated anode has an anode section and a phosphor section provided on this anode section, the phosphor-coated anode is provided along the axial direction at the center of the inside of the vacuum sealing tube, and one or plural wire-shaped cathodes are arranged around the phosphor-coated anode.

7. A lighting device of claim 6, wherein the wire-shaped cathode has a concave/convex formed on its surface, and the carbon film is formed on the surface of the concave/convex.

8. A lighting device of claim 7, wherein the carbon film is carbon nano-tube or carbon nano-wall.

9. A lighting device comprising:

a wire-shaped cathode provided along an axial direction;

a phosphor-coated anode that opposes to the wire-shaped cathode in the axial direction; and a vacuum sealing tube that vacuum-seals these cathode and anode, wherein the wire-shaped cathode has a wire and a carbon film provided on the outer circumference of this wire as an electron emitter, and the phosphor-coated anode has an anode section and a phosphor section provided on this anode section, the wire-shaped cathode is provided along the axial direction at the center of the inside of the vacuum sealing tube, the phosphor-coated anode is provided along the axial direction on the inner peripheral surface of the vacuum sealing tube, and the wire-shaped cathode has a concave/convex formed on its surface, and the carbon film is formed on the surface of the concave/convex.

10. A lighting device of claim 9, wherein the carbon film is carbon nano-tube or carbon nano-wall.

11. A lighting device comprising:

a wire-shaped cathode provided along an axial direction;

a phosphor-coated anode that opposes to the wire-shaped cathode in the axial direction; and a vacuum sealing tube that vacuum-seals these cathode and anode, wherein the wire-shaped cathode has a wire and a carbon film provided on the outer circumference of this wire as an electron emitter, and the phosphor-coated anode has an anode section and a phosphor section provided on this anode section, the phosphor-coated anode and the wire-shaped cathode are arranged in the vacuum sealing tube along the axial direction so as to be generally parallel to each other, and the wire-shaped cathode has a concave/convex formed on its surface, and the carbon film is formed on the surface of the concave/convex.

12. A lighting device of claim 11, wherein the carbon film is carbon nano-tube or carbon nano-wall.

* * * * *